US007836978B2

(12) United States Patent
Scott

(10) Patent No.: US 7,836,978 B2
(45) Date of Patent: Nov. 23, 2010

(54) CUTTING ELEMENTS FOR CASING COMPONENT DRILL OUT AND SUBTERRANEAN DRILLING, EARTH BORING DRAG BITS AND TOOLS INCLUDING SAME AND METHODS OF USE

(75) Inventor: Danny E. Scott, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 181 days.

(21) Appl. No.: 11/764,008

(22) Filed: Jun. 15, 2007

(65) Prior Publication Data

US 2008/0308276 A1 Dec. 18, 2008

(51) Int. Cl.
*E21B 10/44* (2006.01)

(52) U.S. Cl. ..... 175/426

(58) Field of Classification Search ..... 175/426, 175/433, 434

See application file for complete search history.

(56) References Cited

U.S. PATENT DOCUMENTS

| | | | | | |
|---|---|---|---|---|---|
| 3,743,489 | A | | 7/1973 | Wentorf, Jr. et al. | |
| 4,255,165 | A | * | 3/1981 | Dennis et al. | 51/309 |
| 4,268,276 | A | * | 5/1981 | Bovenkerk | 51/295 |
| 4,374,651 | A | | 2/1983 | Lee et al. | |
| 4,702,649 | A | * | 10/1987 | Komanduri | 407/119 |
| 4,943,488 | A | | 7/1990 | Sung et al. | |
| 5,025,874 | A | * | 6/1991 | Barr et al. | 175/430 |
| 5,027,912 | A | * | 7/1991 | Juergens | 175/426 |
| 5,049,164 | A | | 9/1991 | Horton et al. | |
| 5,135,061 | A | * | 8/1992 | Newton, Jr. | 175/428 |
| 5,435,403 | A | | 7/1995 | Tibbitts | |
| 5,499,688 | A | | 3/1996 | Dennis | |
| 5,566,779 | A | * | 10/1996 | Dennis | 175/426 |
| 5,597,625 | A | | 1/1997 | Ong et al. | |
| 5,629,053 | A | | 5/1997 | Treichel et al. | |

(Continued)

FOREIGN PATENT DOCUMENTS

| | | | |
|---|---|---|---|
| GB | 2345503 | A | 7/2000 |

(Continued)

OTHER PUBLICATIONS

U.S. Appl. No. 11/928,956, filed Oct. 30, 2007, entitled "Earth Boring Drill Bits with Casing Component Drill Out Capability and Methods of Use," by Eric. E. McClain et al.

(Continued)

*Primary Examiner*—Jennifer H Gay
*Assistant Examiner*—Blake Michener
(74) *Attorney, Agent, or Firm*—TraskBritt

(57) ABSTRACT

A drill bit or milling tool includes a bit body on which a plurality of cutting elements are disposed. At least some of the plurality of cutting elements include a diamond table and a superabrasive material non-reactive with iron-based materials disposed over at least a portion of an exterior surface of the diamond table. The diamond table is suitable for drilling through a subterranean formation and the non-reactive superabrasive material is suitable for drilling through a casing or casing-associated component comprising an iron-based material and disposed within the subterranean formation. The diamond table may comprise a PDC and the non-reactive superabrasive material may comprise cubic boron nitride.

10 Claims, 6 Drawing Sheets

U.S. PATENT DOCUMENTS

| | | | | |
|---|---|---|---|---|
| 5,639,551 | A | 6/1997 | Ong et al. | |
| 5,723,188 | A | 3/1998 | Luthje et al. | |
| 5,979,571 | A | 11/1999 | Scott et al. | |
| 6,062,326 | A | 5/2000 | Strong et al. | |
| 6,131,675 | A * | 10/2000 | Anderson | 175/268 |
| 6,135,219 | A | 10/2000 | Scott | |
| 6,216,805 | B1 | 4/2001 | Lays et al. | |
| 6,315,065 | B1 * | 11/2001 | Yong et al. | 175/428 |
| 6,499,547 | B2 * | 12/2002 | Scott et al. | 175/374 |
| 6,579,045 | B1 | 6/2003 | Fries et al. | |
| 6,612,383 | B2 * | 9/2003 | Desai et al. | 175/61 |
| 6,779,951 | B1 | 8/2004 | Vale et al. | |
| 7,178,609 | B2 | 2/2007 | Hart et al. | |
| 7,395,882 | B2 * | 7/2008 | Oldham et al. | 175/402 |
| 2001/0004946 | A1 * | 6/2001 | Jensen | 175/428 |
| 2003/0019106 | A1 * | 1/2003 | Pope et al. | 29/898 |
| 2004/0159469 | A1 | 8/2004 | Overstreet et al. | |
| 2005/0133277 | A1 * | 6/2005 | Dixon | 175/426 |
| 2005/0183892 | A1 | 8/2005 | Oldham et al. | |
| 2006/0016626 | A1 * | 1/2006 | Lund et al. | 175/431 |
| 2006/0070771 | A1 | 4/2006 | McClain et al. | |
| 2006/0144621 | A1 | 7/2006 | Tank et al. | |
| 2007/0029116 | A1 * | 2/2007 | Keshavan | 175/428 |
| 2007/0079995 | A1 | 4/2007 | McClain et al. | |
| 2007/0175672 | A1 * | 8/2007 | Eyre et al. | 175/426 |
| 2007/0289782 | A1 | 12/2007 | Clark et al. | |
| 2008/0149393 | A1 * | 6/2008 | McClain et al. | 175/57 |

FOREIGN PATENT DOCUMENTS

| | | | |
|---|---|---|---|
| GB | 2351987 | A | 1/2001 |
| WO | 9936215 | A1 | 7/1999 |

OTHER PUBLICATIONS

PCT International Search Report mailed Feb. 2, 2009 for International Application No. PCT/US2008/066300.

* cited by examiner

CUTTING ELEMENTS FOR CASING COMPONENT DRILL OUT AND SUBTERRANEAN DRILLING, EARTH BORING DRAG BITS AND TOOLS INCLUDING SAME AND METHODS OF USE

FIELD OF THE INVENTION

Embodiments of the present invention relate generally to drilling a subterranean bore hole and, more specifically, to drill bits and tools for drilling subterranean formations and having a capability for drilling out structures and materials which may be located at, or proximate to, the end of a casing or liner string, such as a casing bit or shoe, cementing equipment components and cement as well as drilling through the side wall of the casing or liner string and surrounding cement.

BACKGROUND

Drilling wells for oil and gas production conventionally employs longitudinally extending sections, or so-called "strings," of drill pipe to which, at one end, is secured a drill bit of a larger diameter. After a selected portion of the bore hole has been drilled, a string of tubular members of lesser diameter than the bore hole, known as casing, is placed in the bore hole. Subsequently, the annulus between the wall of the bore hole and the outside of the casing is filled with cement. Therefore, drilling and casing according to the conventional process typically requires sequentially drilling the bore hole using drill string with a drill bit attached thereto, removing the drill string and drill bit from the bore hole, and disposing and cementing a casing into the bore hole. Further, often after a section of the bore hole is lined with casing and cemented, additional drilling beyond the end of the casing or through a sidewall of the casing may be desired. In some instances, a string of smaller tubular members, known as a liner string, is run and cemented within previously run casing. As used herein, the term "casing" includes tubular members in the form of liners.

Because sequential drilling and running a casing or liner string may be time consuming and costly, some approaches have been developed to increase efficiency, including reamer shoes and drilling with casing. Reamer shoes employ cutting elements on the leading end that can drill through modest obstructions and irregularities within a bore hole that has been previously drilled. Reamer shoes also include an inner section manufactured from a material which is drillable by drill bits. Accordingly, when cemented into place, reamer shoes usually pose no difficulty to a subsequent drill bit to drill through. For instance, U.S. Pat. No. 6,062,326 to Strong et al. discloses a casing shoe or reamer shoe in which the central portion thereof may be configured to be drilled through. However, the use of reamer shoes requires the retrieval of the drill bit and drill string used to drill the bore hole before the casing with the reamer shoe is run into the bore hole.

Drilling with casing employs a drill bit, termed a "casing bit," attached to the end of the casing string. The casing bit functions not only to drill the earth formation, but also to guide the casing into the bore hole. The casing is, thus, run into the bore hole as it is formed by the casing bit, eliminating the necessity of retrieving a drill string and casing bit after reaching a target depth where cementing is desired. However, in many instances further drilling laterally from the casing or beyond the end of the casing may be desired, requiring drilling through the casing side wall or through or around the casing bit.

Drilling through casing or casing-associated components (casing shoe, casing bit, casing wall, cementing equipment and cement, etc.) may result in damage to the drill bit or tool run into the casing string. Casing as well as casing-associated components often employ iron-based materials in the form of iron-based alloys. Diamond, including specifically polycrystalline diamond compacts, or "PDC's" employed as cutting elements in conventional fixed cutter bits, or "drag" bits, is reactive with iron at high temperatures such as are generated at the cutting edges of such cutting elements during a drilling operation. Therefore, using a conventional drag bit or tool using solely PDC cutting elements to drill through casing or casing-associated components may severely deteriorate the diamond cutting table of the PDC cutting elements, to the extent they are not suitable for further drilling through subterranean formations. This is especially true in high strength alloy steel or "duplex" alloy steel casings. The drag bit or tool must then be retrieved and replaced before drilling resumes.

Special tools known as mills or milling tools have historically been employed in order to drill through casing side wall. Unfortunately, most of these tools are unable to penetrate both the casing sidewall and adjacent subterranean formation effectively to any substantial distance. Therefore, the mill must conventionally be retrieved from the hole and replaced with a drill bit after drilling through the casing side wall is completed. Such a procedure somewhat compromises any time and expense saved by drilling with casing. Several devices have been developed for avoiding damage to the milling tool or the need to retrieve tools used to drill through the casing before drilling any substantial distance into the surrounding formation.

One approach for drilling through casing and casing-associated components includes employing a drill bit or tool having a face on which two different types of cutting elements are disposed. The first type of cutting elements comprise a superabrasive material such as polycrystalline diamond and the second type of cutting elements comprise an abrasive material such as tungsten carbide. The second type of cutting elements exhibit a relatively greater exposure than the first type of cutting elements, so as to engage the interior of the casing or casing-associated components, after which the second type of cutting elements quickly wear away upon engagement with the subterranean formation. Such an approach is disclosed in U.S. Patent Publications 2007/0079995 and 2006/0070771, each of which is assigned to the assignee of the present invention.

One drawback associated with providing two sets of cutting elements on a drill bit or tool is an inability to provide an optimum cutting element layout for drilling the formation after penetration of casing or casing components and surrounding cement. This issue manifests itself not only in problems with attaining an optimum cutting action, but also in problems, due to the presence of the required two sets of cutting elements, with implementing a bit hydraulics scheme effective to clear formation cuttings using drilling fluid when any substantial rate of penetration (ROP) is sought.

To enable effective drilling of casing and casing-associated components manufactured from robust, relatively inexpensive and drillable iron-based material such as, for example, high strength alloy steels which are generally non-drillable by diamond cutting elements as well as enhanced subsequent drilling effectiveness through the surrounding formation, it would be desirable to have a drag bit or tool offering the capability of drilling through such casing or casing-associated components, while at the same time offering the subterranean drilling capabilities of a conventional drag bit or tool employing superabrasive cutting elements.

BRIEF SUMMARY OF THE INVENTION

Embodiments of the present invention comprise a diamond table having at least a portion of an exterior surface thereof coated with another superabrasive material which is non-reactive with iron-based materials.

Embodiments of the present invention comprise an apparatus for drilling through casing or casing-associated components using cutting elements comprising a superabrasive material for contacting the casing or casing-associated components which is non-reactive with iron-based materials and which may be worn away after penetration of the casing or casing-associated component to expose a superabrasive material in the form of a diamond table for drilling through an adjacent subterranean formation using the exposed diamond of the cutting element.

A method of drilling a bore hole is also provided. The method includes bore hole contacting and cutting through at least one casing element and into an adjacent subterranean formation using an apparatus bearing cutting elements which comprise a superabrasive material which is non-reactive with iron-based materials covering at least a portion of an exposed surface of a diamond table using substantially only the non-reactive superabrasive material of the cutting elements, wearing away the non-reactive superabrasive material to expose at least a portion of the diamond tables of the cutting elements and drilling a bore hole into the adjacent subterranean formation with the apparatus, using the exposed at least a portion of the diamond tables of the cutting elements.

DETAILED DESCRIPTION

In the following detailed description of the invention, numerous specific details are set forth in order to provide a thorough understanding of the invention. However, one of ordinary skill in the art would recognize that the invention may be practiced without these specific details. In other instances, well known methods, procedures, and/or components have not been described in detail so as not to unnecessarily obscure aspects of the invention.

In the following description, certain terminology is used to describe certain features of one or more embodiments of the invention. For instance, the term "casing-associated components" means and includes drill shoes, drill bits, casing wall, cementing equipment and/or cement associated with a casing or liner string. "Iron-based material" means and includes materials, such as steel alloys, including without limitation high chrome duplex steel alloys, having a sufficient proportion of iron therein so as to be reactive with diamond at temperatures commonly generated during machining processes. Depending on whether the diamond is in the form of PDC or natural diamonds, and further depending on the presence and make-up of a catalyst material with PDC, the carbon may begin to react with the iron-based material at around 750 degrees C.

One embodiment of the present invention provides a drag bit or tool for drilling through casing or casing-associated components comprising an iron-based material as well as further drilling through subterranean formations. Further embodiments of the present invention comprise cutting elements suitable for use with a drill bit or tool which are capable of drilling through both casing and casing-associated components comprising an iron-based material and, subsequently, through an adjacent subterranean formation, and methods of drilling.

Figure 1:
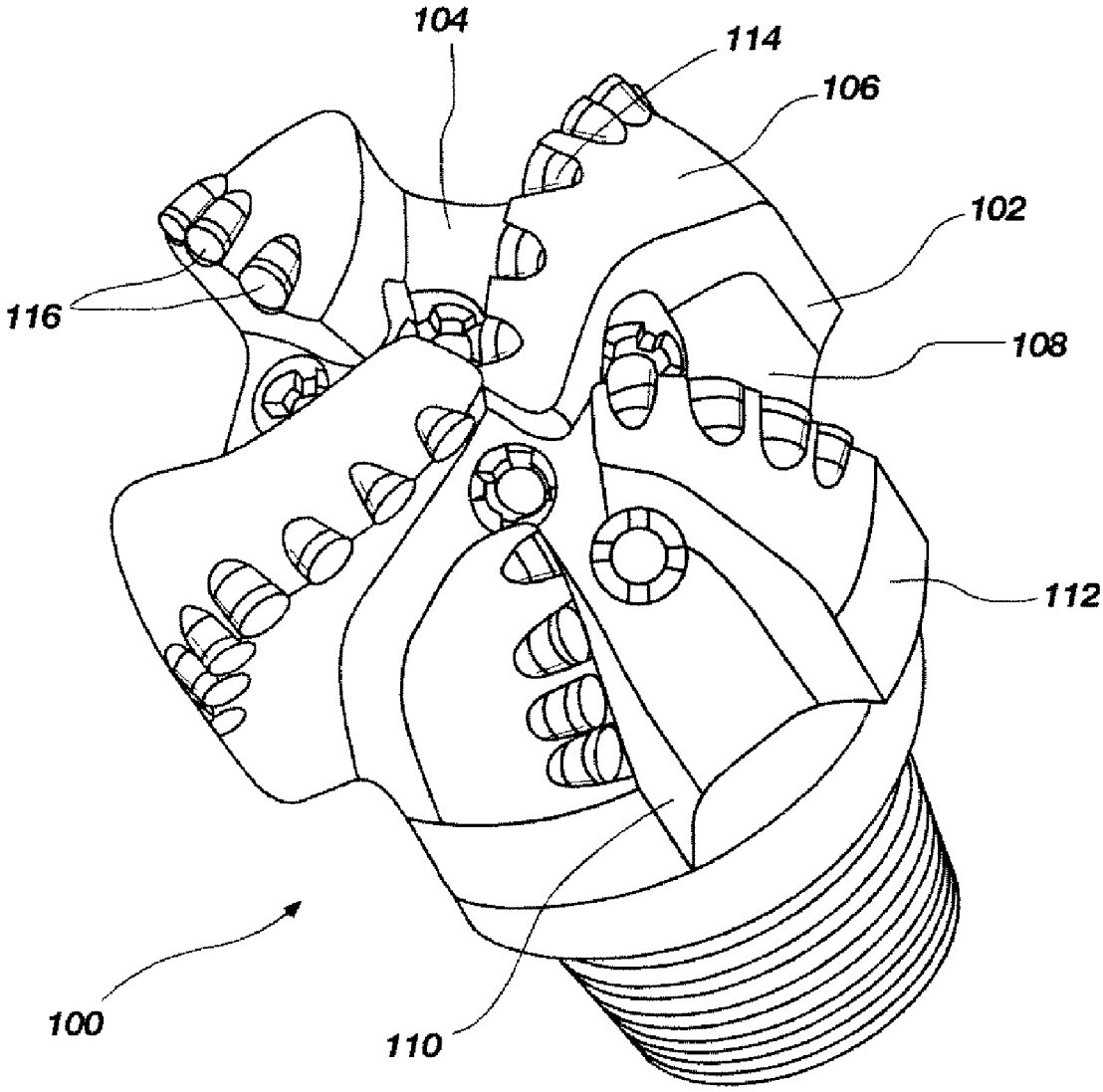
FIG. 1 illustrates a drill bit in the form of a fixed cutter or so-called "drag" bit, according to one example of the present invention.

FIG. 1 illustrates a drill bit in the form of a fixed cutter or so-called "drag" bit, according to one embodiment of the present invention. Drill bit 100 includes a body 102 having a face 104 and generally radially extending blades 106, forming fluid courses 108 therebetween extending to junk slots 110 between circumferentially adjacent blades 106. Bit body 102 may comprise a tungsten carbide matrix or a steel body, both as well known in the art.

Blades 106 may include a gage region 112 which is configured to define the outermost radius of the drill bit 100 and, thus, the radius of the wall surface of a bore hole drilled thereby. Gage regions 112 comprise longitudinally upward (as the drill bit 100 is oriented during use) extensions of blades 106 and may have wear-resistant inserts or coatings, such as cutting elements, or hardfacing material, on radially outer surfaces thereof as known in the art to inhibit excessive wear thereto.

Drill bit 100 may also be provided with pockets 114 in blades 106 which may be configured to receive cutting elements 116. Cutting elements 116 may be affixed upon the blades 106 of drill bit 100 by way of brazing, welding, or as otherwise known in the art. Cutting elements 116 are configured to be capable of cutting through subterranean formations after cutting through the material of casing or casing-associated components. Cutting elements 116 may, therefore, comprise a diamond table portion suitable for drilling through subterranean features at least partially covered with another superabrasive material which is non-reactive with iron and suitable for drilling through casing or casing-associated components. As used herein, the term "diamond table" is non-limiting of the physical configuration of the diamond portion of the cutting element, and encompasses both single crystal diamond, diamond-to-diamond bonded aggregates of diamond grit and structures of a hard material, for example, a carbide impregnated with natural diamond or synthetic diamond grit, or a combination thereof. Such structures are exemplified by so-called "impregnated segments" used on drag bits for extremely hard formation drilling. Further, the term "diamond table" means a structure of sufficient strength and impact resistance to be suitable for cutting subterranean (rock) formations.

The diamond table portion of cutting elements 116 may comprise a polycrystalline diamond compact (PDC) which may be characterized as a mutually bonded mass of diamond particles or "grit," exhibiting diamond-to-diamond bonds. PDCs are formed from a volume of diamond particles subjected, in the presence of a catalyst, to ultra-high pressure, ultra-high temperature (HPHT) conditions, as is well known to those of ordinary skill in the art. It is also contemplated that the diamond table portion may comprise a thermally stable polycrystalline product (TSP) which may be characterized as a PDC from which the catalyst has been substantially removed, a single crystal nature diamond, or a diamond grit-impregnated segment, as known in the art and as may be selected in consideration of the subterranean formation or formations to be drilled. Such a diamond table portion in the form of a PDC is conventionally disc-shaped and may be formed on and bonded to a supporting substrate of, for example, cemented tungsten carbide, as is well known in the art. If another type of diamond table is employed of the type described above, the diamond table may be directly furnaced into a matrix-type bit body, or brazed to such a body or to a steel-body bit. At least a portion of a diamond table comprising a TSP or a natural diamond may be treated to facilitate metallurgical bonding thereof to a matrix-type bit body, again as is well known in the art. Specifically, such a diamond table material may be coated with a single layer or multiple layers of a refractory material, as known in the art and disclosed in U.S. Pat. Nos. 4,943,488 and 5,049,164, the disclosure of each of which is hereby incorporated herein by reference in their entirety.

The superabrasive material which is non-reactive with iron-based materials may, in some embodiments, comprise a cubic boron nitride (CBN) film disposed on or over at least a portion of an exterior surface of the diamond table. However, the non-reactive superabrasive portion may comprise another superabrasive material that is not attacked by iron. By way of example, cubic zirconia ($ZrO_2$) or synthetic moissanite (a crystallized silicon carbide) may be employed. The CBN film may be formed on and bonded to the diamond table by any suitable technique known in the art. For example, as disclosed in U.S. Pat. No. 5,597,625 to Ong et al., a CBN film may be deposited on diamond using chemical vapor deposition (CVD) techniques. The disclosure of the Ong et al. patent is incorporated herein in its entirety by reference.

In other embodiments, the superabrasive which is non-reactive with iron-based materials may comprise a discrete mass formed on a diamond table, or bonded thereto. For example, CBN grit may be disposed adjacent to a diamond table and formed into a CBN mass bonded to the diamond table under HPHT conditions using techniques disclosed in U.S. Pat. Nos. 3,743,489 and 4,374,651, the disclosures of which are incorporated herein in their entirety by this reference. As another approach, a CBN preform may be metallurgically bonded to a diamond table using techniques disclosed in previously referenced U.S. Pat. Nos. 4,943,488 and 5,049,164.

Figure 2A:
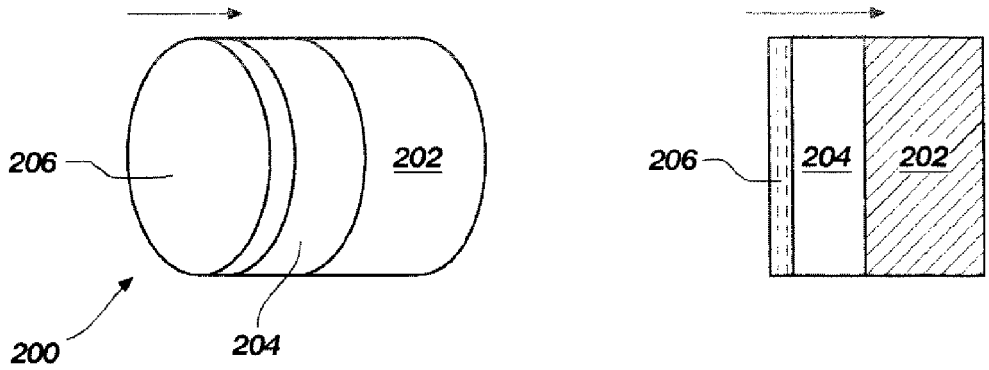
FIGS. 2A-2E illustrate perspective views along with an associated cross-section view of cutting elements of suitable configurations according to different exemplary implementations of the present invention.

FIGS. 2A-2E illustrate perspective views and associated cross-section views of cutting elements 200 of various configurations according to different embodiments of the present invention. For the sake of clarity, like numerals have been used to identify like features in FIGS. 2A-2E. An embodiment of a cutting element 200 of the invention is illustrated in FIG. 2A. A substrate 202 may be provided, comprising cemented tungsten carbide or any material commonly known in the art. A diamond table portion 204 may be disposed on the substrate 202 and bonded thereto. Diamond table portion 204 may comprise, for example, a PDC table configured conventionally as a disc as known to those of ordinary skill in the art. A superabrasive material comprising portion 206 which is non-reactive with iron-based materials (also termed a "non-reactive superabrasive") may be disposed over the diamond table portion 204 such that the diamond table portion 204 is sandwiched between the substrate 202 and the non-reactive superabrasive portion 206.

Figure 2B:
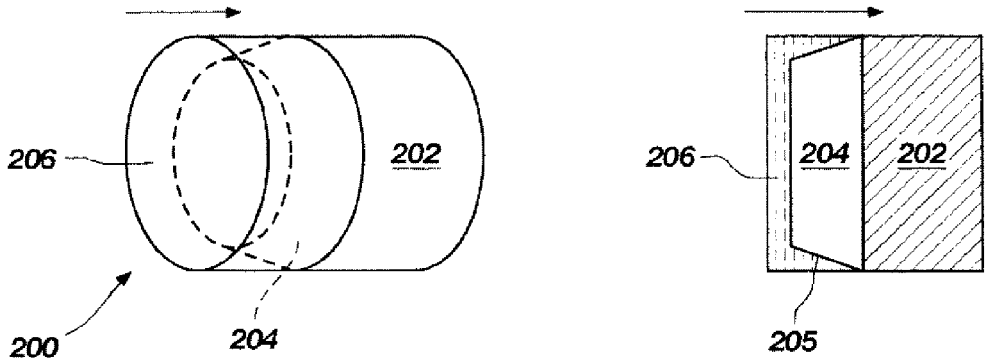

In another embodiment of the present invention depicted in FIG. 2B, a substrate 202 may be provided with diamond table portion 204 disposed thereon and bonded thereto. Diamond table portion 204 may be configured in a frustoconical shape to extend away from substrate 202 with a tapered side wall 205 such that the diameter of diamond table portion 204 decreases as the distance from substrate 202 increases. The diameter of diamond table portion 204 at the surface which is bonded to substrate 202 may be substantially the same as the diameter of substrate 202. The sidewall of diamond table portion 204 may taper linearly inwardly as shown, it may taper arcuately with a radius that is concave or convex, it may taper inwardly with side wall geometries such as waves, steps, scallops and/or teeth, or may exhibit any other geometry known, for example, as described in the aforementioned U.S. Patent Applications 2007/0079995, which is incorporated herein by reference. Non-reactive superabrasive portion 206 may be disposed over diamond table portion 204 and configured to encapsulate diamond table portion 204 on all sides except the side which is bonded to substrate 202. Non-reactive superabrasive portion 206 may have substantially the same outer cylindrical shape as substrate 202 or (not shown) may evenly coat the exterior surfaces of diamond table portion 204 and, so exhibit a frustoconical outer surface.

Figure 2C:
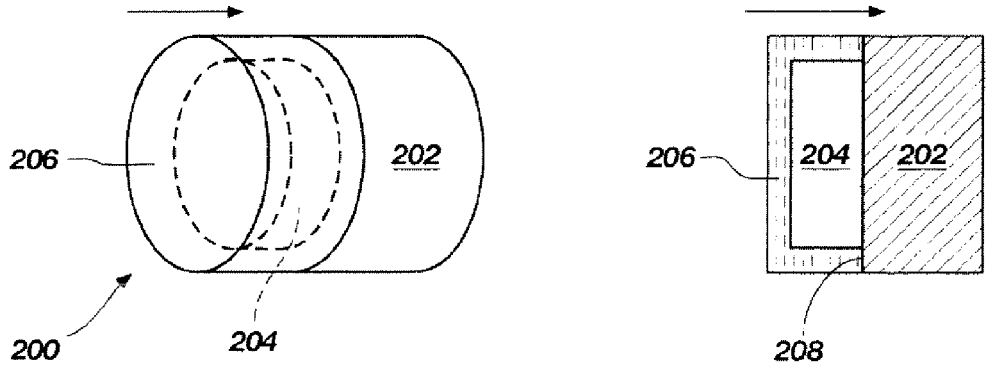

In another embodiment of the present invention, as depicted in FIG. 2C, diamond table portion 204 may be disposed on and bonded to substrate 202. Diamond table portion 204 may be configured cylindrically with a diameter smaller than the diameter of substrate 202, and be concentric therewith so as to expose an annular shoulder 208 on the end of substrate 202 abutting diamond table portion 204. Non-reactive superabrasive portion 206 may be disposed over diamond table portion 204 so as to encapsulate diamond table portion 204 on all exposed sides. Non-reactive superabrasive portion 206 may have substantially the same outer diameter as substrate 202.

Figure 2D:
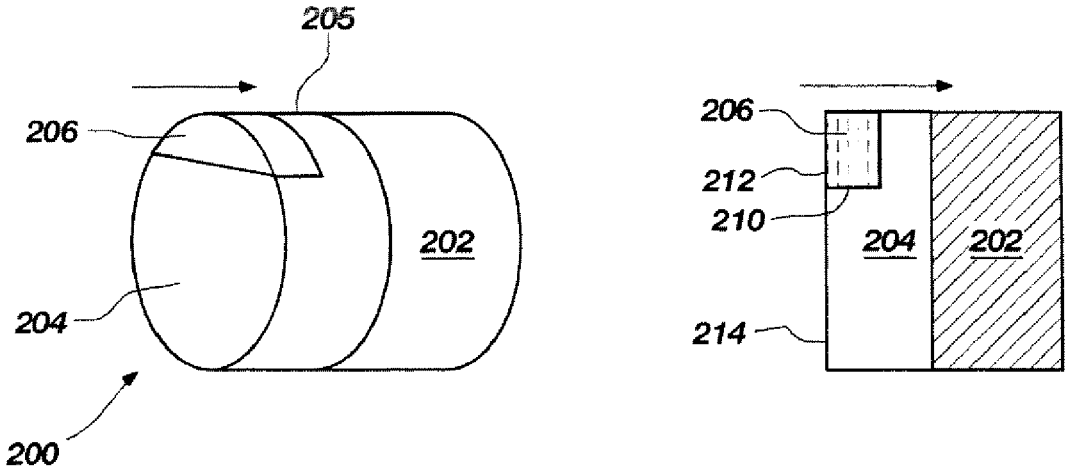

FIG. 2D illustrates another embodiment of the present invention including a substrate 202. Substrate 202 may have diamond table portion 204 disposed thereon and bonded thereto. In this embodiment, the end of the diamond table portion 204 abutting substrate 202 may be configured to be of the same shape and size as substrate 202 such that the outer side wall of diamond table portion 204 and that of substrate 202 may be substantially coextensive. A shelf or shoulder 210 may be formed on a portion of the end of diamond table portion 204 facing away from substrate 202, wherein non-reactive superabrasive portion 206 may be disposed. As noted above, the non-reactive superabrasive portion may comprise a preformed CBN mass bonded to diamond table portion 204, or a CBN mass formed on diamond table portion 204 under HPHT conditions. As shown, non-reactive superabrasive portion 206 may have a front, or cutting face portion 212 coextensive with cutting face 214 of diamond table portion 204, and a side wall coextensive with the side wall 205 of diamond table portion 204.

Figure 2E:
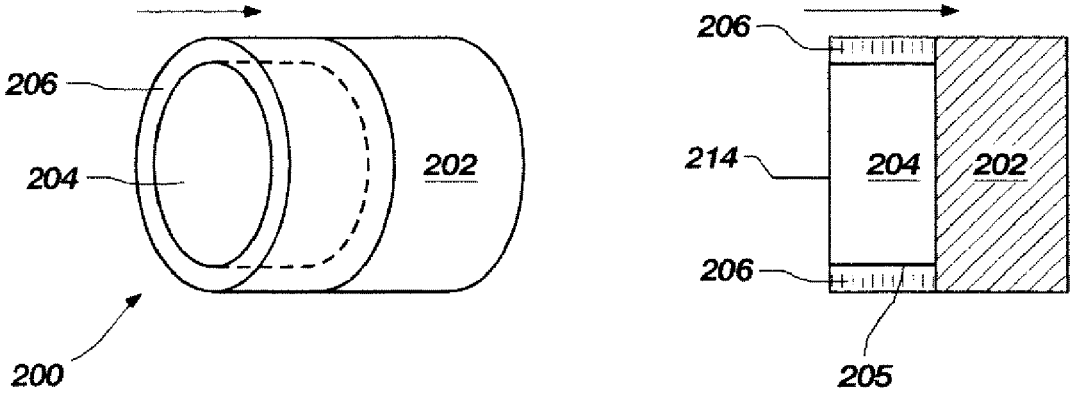

Another configuration for an embodiment of a cutting element 200 is illustrated in FIG. 2E. Substrate 202 may have diamond table portion 204 disposed thereon and bonded thereto. Diamond table portion 204 may be of cylindrical configuration with an outer diameter smaller than, and concentric with, the outer diameter of substrate 202. Non-reactive superabrasive portion 206 may be disposed around the side wall 205 of diamond table portion 204 in a manner similar to the structure of FIG. 2C, except non-reactive superabrasive portion 206 does not extend over cutting face 214 of diamond table portion 204.

Each of the preceding embodiments illustrated in FIGS. 2A-2E positions non-reactive superabrasive portion 206 to contact and cut casing or any casing-associated component comprising an iron-based material to drill therethrough, while preventing damage to diamond table portion 204 which may result from contacting iron-based material the casing or casing-associated components under high temperatures generated during drilling. Casing, casing-associated component, and/or subterranean features move across the cutting elements 200 in the direction of the arrows. After drilling through the casing or one or more casing-associated components and through cement which conventionally surrounds casing and is disposed at the end thereof adjacent the bottom of a bore hole, non-reactive superabrasive portion 204 may wear away upon encountering the adjacent subterranean formation, exposing diamond table portion 204 for further drilling.

The appropriate thickness of non-reactive superabrasive portion 206, including a safety margin, may be calculated by determining or predicting the volume, in terms of thickness, of the non-reactive superabrasive portion 206 which may be worn away when drilling through the iron-based material of casing or casing-associated components. The thickness of non-reactive superabrasive portion 206 may be such that the thickness of the non-reactive superabrasive portion 206 is substantially but not completely worn away by the time the drill bit or milling tool has drilled or milled, respectively, through any casing or casing-associated components. In this manner, the drill bit may be used to drill or mill through iron-based materials using the non-reactive superabrasive portion before there is a risk of exposure of the diamond table portion 204. At any time after the iron-based material has been completely penetrated, the non-reactive portion may be quickly worn away and the diamond table 204 exposed to drill a bore hole into the subterranean formation.

Although the examples in FIGS. 2A-2E show each cutting element in a circular configuration, it will be apparent to one of ordinary skill in the art that the cutting elements may be configured in a variety of suitable geometric shapes including, but not limited to, ovoid, rectangular, tombstone, etc. The basic principles described above as they relate to the illustrated circular configurations also apply to any variation of geometric configurations. For example, the configuration illustrated in FIG. 2B may apply as well to an ovoid shape, in which diamond table portion 204 may have a base that is bonded to the substrate 202 and which is configured to be the same shape as substrate 202 and which extends away from substrate 202 with sloping side walls 205 such that the forward surface has a similar shape but smaller dimensions than the base. Furthermore, the cutting elements 200 may be configured with non-planar (for example, dome-shaped) cutting faces, and to include chamfered or radiused cutting edges at the cutting face periphery, as known in the art. In the case of TSP, natural diamond or impregnated segment-type diamond tables, the cutting element geometry may be of any suitable conventional configuration as known in the art.

Figure 3:
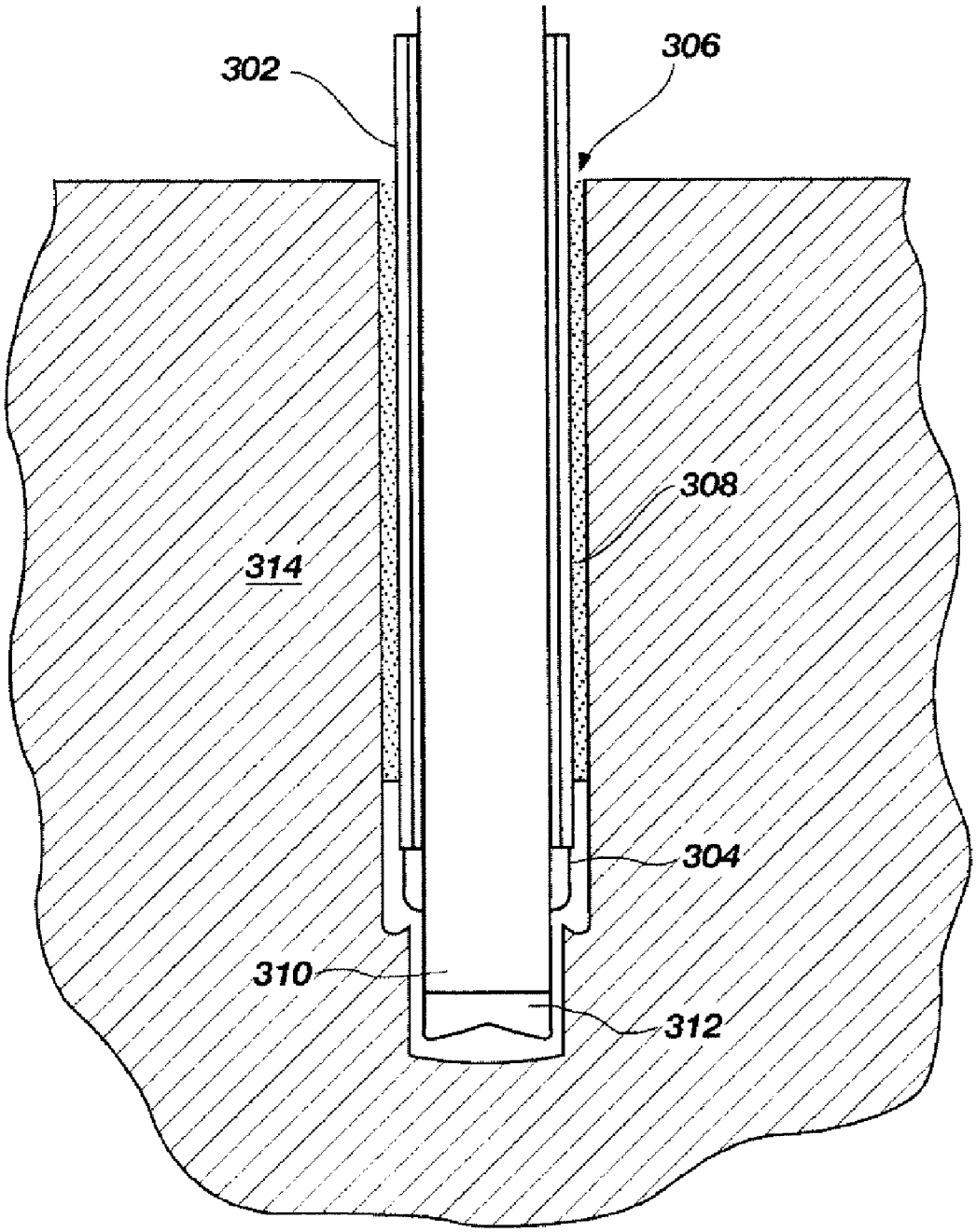
FIG. 3 is a drill bit or casing bit according to one embodiment of the present invention drilling through a casing component at the end of a previously positioned and cemented casing string.

FIG. 3 schematically illustrates a drill bit according to one embodiment of the present invention drilling through the end of a previously positioned and cemented casing and bit. The drill bit 312 may comprise, for example, drill bit 100 as depicted in FIG. 1. Casing 302 including a casing-associated component 304, which may for example and without limitation comprise a casing bit or a float shoe at the distal end thereof is positioned in bore hole 306 and cemented therein with cement sheath 308. Subsequently, drill string 310 and drill bit 312 disposed within casing 302 may be used to engage the casing-associated component 304 of first casing 302 near the bottom of bore hole 306. The cutting elements (not shown) of second drill bit 312 may include a diamond table portion and a non-reactive superabrasive portion, as described above with respect to FIGS. 2A-2E. The non-reactive superabrasive portion may mill through the casing-associated components of the first casing 302 and wear down during the milling process such that when second drill bit 312 engages subterranean features 314, the diamond table portion is exposed.

Figure 4:
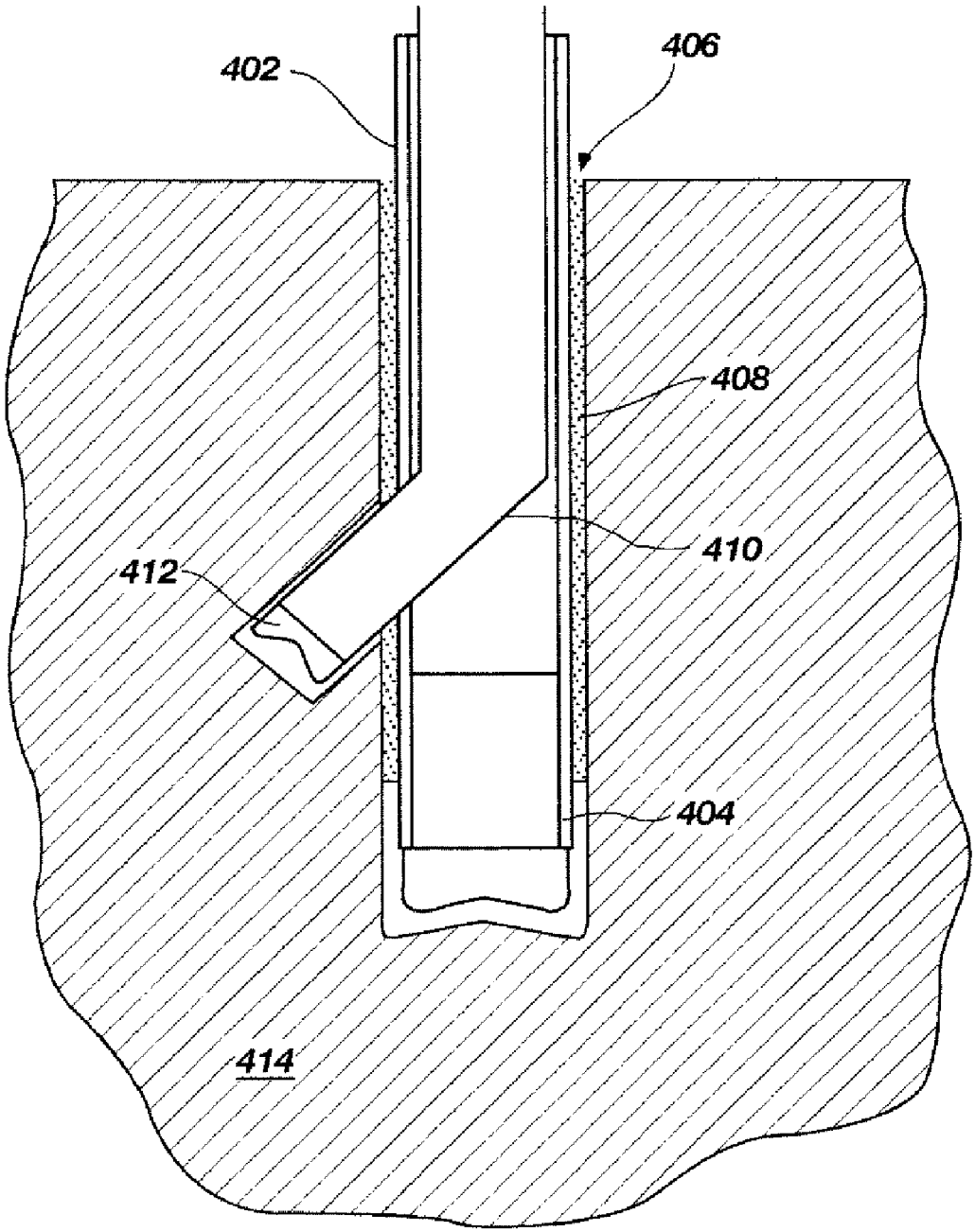
FIG. 4 illustrates a drill bit or casing bit according to one embodiment of the present invention drilling through the side wall of a previously positioned and cemented casing string.

FIG. 4 illustrates a tool according to one embodiment of the present invention drilling through the side wall of a previously positioned and cemented casing 402 and bit. Casing 402 including, for example, casing bit 404 at the distal end thereof is positioned in bore hole 406 and cemented in the bore hole with cement sheath 408. Subsequently, drill string 410 and tool 412, which may be configured as a milling tool or as a drill bit, may engage the side wall of first casing 402 under the guidance of a whipstock (not shown), as is well known in the art. At least some of the cutting elements (not shown) of tool 412, particularly those at a periphery of tool 412, may include a diamond table portion and a non-reactive superabrasive portion disposed over at least a portion of the diamond table, as described above with respect to FIGS. 2A-2E. The non-reactive superabrasive portion may be used to mill through the casing side wall of casing 402 and cement sheath 408 and wear down thereafter upon encountering subterranean formation 414.

Figure 5:
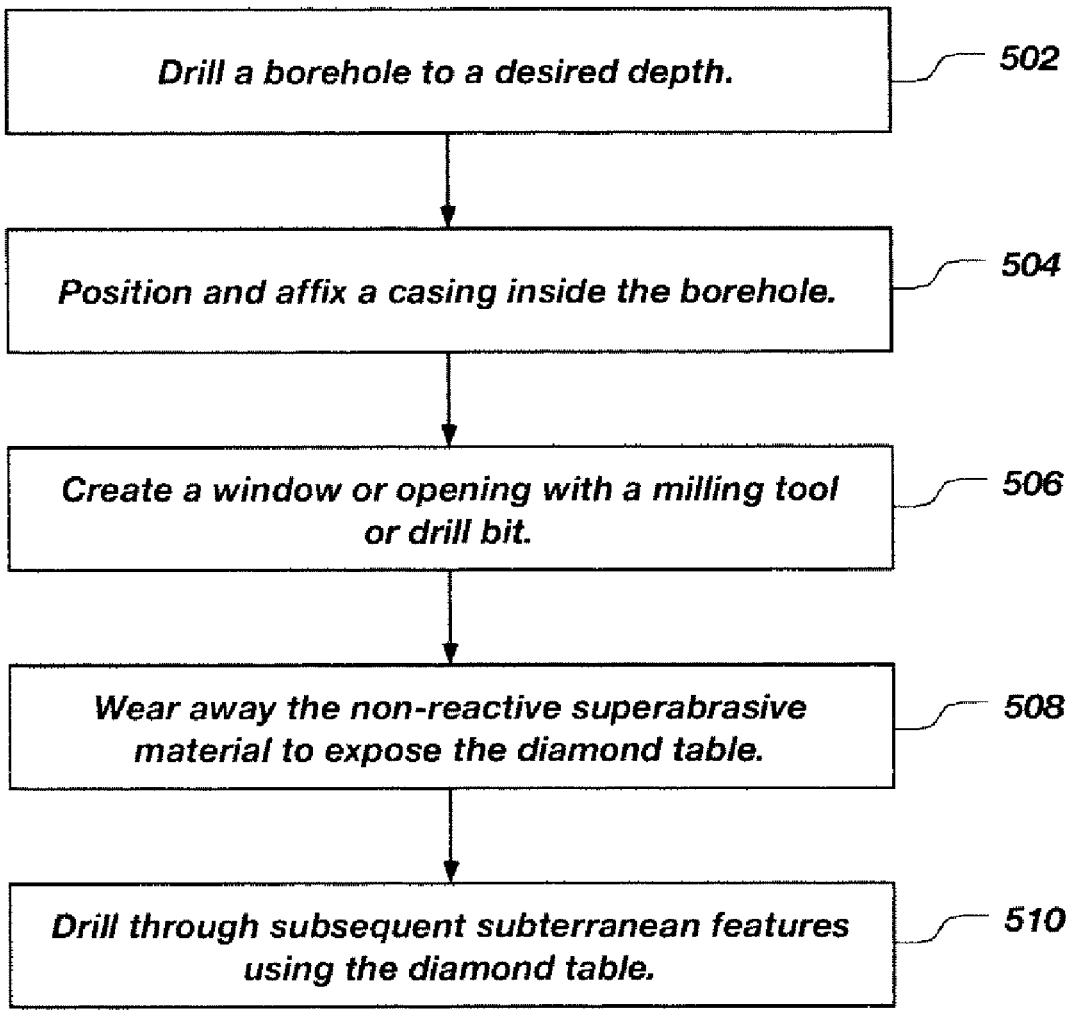
FIG. 5 is a flow diagram illustrating a method of drilling a bore hole after a casing string has been positioned and cemented into place.

FIG. 5 is a flow diagram schematically illustrating a method of drilling a bore hole after a previous casing has been positioned and cemented into place. A first bore hole may be drilled to a desired depth 502 and a casing may be positioned and affixed therein 504. The casing may be positioned during drilling by using a drilling with casing method and the casing may be affixed with cement. However, it will be apparent to those of skill in the art that any method known in the art may be used for forming the first bore hole and disposing the casing inside the first bore hole.

A window or opening may be drilled or milled through a side wall portion of the casing or through a casing-associated component at the distal end thereof using, respectively a milling tool or a drill bit 506. The drill bit or milling tool may include a plurality of cutting elements as previously described herein, which may be configured to employ a non-reactive superabrasive material to initially contact any casing-associated components to be milled, such material being subsequently worn away and a diamond table employed to drill an adjacent subterranean formation.

The non-reactive superabrasive material may be worn away to expose the diamond table 508 during the milling of the window or opening. Once the drill bit is through the casing or casing-associated components, the exposed diamond table may be used to drill through subsequent subterranean features 510. This process may be repeated with subsequent drill strings and/or casing strings until a desired depth/location is reached.

While certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and equivalents, of the claims which follow.

What is claimed is:

1. A subterranean drilling tool, comprising:

a body having a face at a leading end thereof and structure at a trailing end thereof for connecting to a drill string;

a plurality of cutting elements disposed over the body, wherein at least some cutting elements of the plurality have a cylindrical shape and comprise:

a cylindrical substrate having a cylindrical side surface;

a diamond table disposed on and substantially coextensive with an end of the substrate along an interface, the diamond table having a frustoconical shape including a side wall tapering inwardly as the diamond table extends longitudinally away from the substrate, a diameter of the diamond table decreasing as the distance from the end of the substrate increases; and a superabrasive material selected from the group consisting of cubic boron nitride, cubic zirconia, and synthetic moissanite, the superabrasive material disposed over the diamond table, the superabrasive material and the substrate together encapsulating the diamond table, the superabrasive material having a cylindrical side surface continuous and coextensive with the cylindrical side surface of the cylindrical substrate, the cylindrical side surface of the superabrasive material extending to and intersecting a planar end surface of the superabrasive material such that the superabrasive material and the cylindrical substrate have substantially a common outer cylindrical shape.

2. The drilling tool of claim 1, wherein the body comprises a bit body and further comprising a plurality of generally radially extending blades extending over the face, wherein at least one of the at least some of the plurality of cutting elements is disposed on each blade.

3. The drilling tool of claim 1, wherein the diamond table is selected from the group consisting of a polycrystalline diamond compact (PDC), a thermally stable product (TSP), a natural diamond and a diamond-impregnated structure.

4. The drilling tool of claim 1, wherein the at least some cutting elements of the plurality are configured and positioned on the body for drilling of casing or at least one casing component with the superabrasive material.

5. The drilling tool of claim 4, wherein the superabrasive material is of sufficient volume and thickness to drill through the casing or the at least one casing component before wearing away.

6. The drilling tool of claim 5, wherein the sufficient volume and thickness of the superabrasive material is such as to be substantially worn away when the casing or the at least one casing component is completely penetrated by the drilling tool.

7. The drilling tool of claim 5, wherein the at least some cutting elements are further configured and positioned on the body so at least a portion of the exterior surface of the diamond table is exposed for drilling subterranean formation material after the superabrasive material disposed thereover is worn away.

8. The drilling tool of claim 1, wherein the body comprises a body of a milling tool.

9. A cutting element for use in drilling through at least one of casing and at least one casing associated component, and subterranean formation, comprising:

a cylindrical substrate having a cylindrical side surface;

a diamond table disposed on and substantially coextensive with an end of the substrate, the diamond table having a frustoconical shape including a side wall tapering inwardly as the diamond table extends longitudinally away from the substrate, a diameter of the diamond table decreasing as the distance from the end of the substrate increases; and a superabrasive material selected from the group consisting of cubic boron nitride, cubic zirconia, and synthetic moissanite disposed over the diamond table, the superabrasive material and the substrate together encapsulating the diamond table, the superabrasive material having a cylindrical side surface continuous and coextensive with the cylindrical side surface of the cylindrical substrate, the cylindrical side surface of the superabrasive material extending to and intersecting a planar end surface of the superabrasive material such that the superabrasive material and the cylindrical substrate have substantially a common outer cylindrical shape.

10. The cutting element of claim 9, wherein the diamond table is selected from the group consisting of a polycrystalline diamond compact (PDC), a thermally stable product (TSP), a natural diamond and a diamond-impregnated structure.

* * * * *